US009637345B2

(12) United States Patent
Huang

(10) Patent No.: US 9,637,345 B2
(45) Date of Patent: May 2, 2017

(54) ECCENTRIC TAPE SPINDLE

(71) Applicant: Yu-Chun Huang, Taichung (TW)

(72) Inventor: Yu-Chun Huang, Taichung (TW)

( * ) Notice: Subject to any disclaimer, the term of this patent is extended or adjusted under 35 U.S.C. 154(b) by 15 days.

(21) Appl. No.: 14/664,325

(22) Filed: Mar. 20, 2015

(65) Prior Publication Data

US 2016/0236900 A1 Aug. 18, 2016

(30) Foreign Application Priority Data

Feb. 12, 2015 (TW) ..... 104104658 A

(51) Int. Cl.
*B65H 75/10* (2006.01)
*B65H 75/30* (2006.01)
*B65H 35/00* (2006.01)

(52) U.S. Cl.
CPC ..... *B65H 75/10* (2013.01); *B65H 35/0026* (2013.01); *B65H 75/30* (2013.01); *B65H 35/0073* (2013.01); *B65H 2701/377* (2013.01)

(58) Field of Classification Search
CPC .... B65H 75/02; B65H 16/06; B65H 35/0073; B65H 35/0026; B65H 2701/377; B65H 75/10; B65H 35/0033
See application file for complete search history.

(56) References Cited

U.S. PATENT DOCUMENTS 3,125,264 A * 3/1964 English, Jr. ..... B65H 35/002 225/78
3,149,764 A * 9/1964 Waltz ..... B65H 35/0026 225/57
3,709,445 A * 1/1973 Adams ..... B65H 16/005 242/422.5
3,753,839 A * 8/1973 Funke ..... B65H 35/0033 156/527
3,780,964 A * 12/1973 Gonzalez ..... B21C 47/16 206/403
4,069,958 A * 1/1978 Strauss ..... B65C 9/1892 225/16
4,093,138 A * 6/1978 Shafer ..... B65H 35/0006 225/66
4,211,374 A * 7/1980 Salvino ..... B65H 75/02 242/595.1
4,513,864 A * 4/1985 Liebel ..... B65D 85/672 206/303

(Continued)

*Primary Examiner* — Emmanuel M Marcelo
*Assistant Examiner* — Michael Gallion
(74) *Attorney, Agent, or Firm* — Muncy, Geissler, Olds & Lowe, P.C.

(57) ABSTRACT

A tape spindle comprising a first holding portion and a second holding portion individually supporting and fastening to tape rolls of different sizes, wherein the second holding portion is constructed by a column with at least two orthogonal diagonals, and an operating section of the tape roll is extended through an opening of the first holding portion to reach a tape dispenser; therefore, the tape spindle may accommodate the purpose of the user to hold tape rolls on the first holding portion and the second holding portion according to their sizes, and when extending the tape roll held on the second holding portion, the shaft of the tape spindle may not move with the rotation of the tape roll due to the friction force between an inner wall of the tape roll and the second holding portion.

2 Claims, 7 Drawing Sheets

(56) References Cited

U.S. PATENT DOCUMENTS 4,606,485 A * 8/1986 Rankin ..... B65H 35/0006 225/66
4,915,769 A * 4/1990 Heil ..... B65C 11/002 156/527
4,928,864 A * 5/1990 Walker ..... B65H 35/0026 224/162
5,164,038 A * 11/1992 Sundqvist ..... B65H 35/0033 156/577
5,375,791 A * 12/1994 Kline ..... G11B 15/32 242/575
5,683,058 A * 11/1997 Schwarz ..... B65H 16/04 242/578.2
5,782,428 A * 7/1998 Chabot ..... A47K 10/38 242/596.3
5,947,025 A * 9/1999 Huang ..... B41F 17/13 101/288
6,138,941 A * 10/2000 Miyake ..... G03B 27/588 206/397
6,152,398 A * 11/2000 Chen ..... B65H 35/0026 156/527
6,540,002 B1 * 4/2003 Edwards ..... B44C 7/06 156/574
6,616,087 B1 * 9/2003 Chern ..... B65H 16/005 225/34
7,191,979 B2 * 3/2007 Paukov ..... B65H 75/185 242/578.2
7,805,842 B2 * 10/2010 Bland ..... B26B 13/22 225/7
7,950,435 B2 * 5/2011 Lee ..... B65H 35/0033 156/527
8,042,592 B2 * 10/2011 Crawford ..... B65H 35/0033 156/577
2002/0185512 A1 * 12/2002 Shah ..... B65H 35/0026 225/56
2006/0169709 A1 * 8/2006 Bailey ..... B65H 35/0033 221/26
2006/0201632 A1 * 9/2006 Pitzen ..... B65H 35/0033 156/577
2010/0193539 A1 * 8/2010 Fathi ..... B65H 35/0026 221/45
2012/0061414 A1 * 3/2012 Bundy ..... B65H 35/0073 221/1
2012/0305617 A1 * 12/2012 Kuehn ..... B26F 3/02 225/39
2014/0077022 A1 * 3/2014 Huang ..... B65H 35/0026 242/588
2015/0197369 A1 * 7/2015 Amano ..... B65H 75/02 242/595
2015/0210504 A1 * 7/2015 Yu Chen ..... B65H 75/185 242/600
2015/0336761 A1 * 11/2015 Clayson ..... B65H 18/28 156/527

* cited by examiner

ECCENTRIC TAPE SPINDLE

BACKGROUND OF THE INVENTION

1. Technical Field

The invention relates to a tape spindle, and more particularly, to a tape spindle suitable for holding tape rolls of different sizes.

2. Description of Related Art

FIG. 1 shows a conventional tape spindle 1 for pivotally configuring on a tape dispenser, wherein the tape spindle 1 comprises a first holding portion 11, a second holding portion 13, and a shaft 15, and the first holding portion 11 comprises an opening 112 so that a tape roll $T_1$ held on the second holding portion 13 may move with the rotation of the shaft 15 coaxially penetrating the first holding portion 11 and the second holding portion 13, and an operating section of the tape roll $T_1$ may be extended from the second holding portion 13 through the opening 112 of the first holding portion 11 to reach a cutter of the tape dispenser.

However, it may be seen from the structural characteristics of the conventional tape spindle 1 that when the user operates with the tape roll $T_1$ of different sizes, the tape roll $T_1$ held on the second holding portion 13 moves with the rotation of the shaft 15 since the first holding portion 11 and the second holding portion 13 of the tape spindle 1 are coaxially penetrated, and the first holding portion 11 that is originally distanced from the tape roll $T_1$ gradually moves toward the tape roll $T_1$ due to inertia until it contacts with the tape roll $T_1$; therefore, the smoothness of pulling the tape roll $T_1$ and the operating effect are less than satisfactory, and further consequently result in the inconvenience of the usage of the tape dispenser. In view of this, improvements are urgently required.

BRIEF SUMMARY OF THE INVENTION

In view of the above shortcoming and its significance, the present invention provides an eccentric tape spindle suitable for holding tape rolls of different sizes implemented by the following embodiments.

To achieve the above purpose, the present invention provides a tape spindle comprising a first holding portion, a second holding portion, and a shaft for pivotally configuring on a tape dispenser, wherein the first holding portion comprises an opening and a container that is configured on a side of the first holding portion and is open, and the container is connected with the opening, wherein the shaft coaxially penetrates the first holding portion and the second holding portion configured in the container, and the shaft eccentrically penetrates the second holding portion, and wherein the first holding portion and the second holding portion individually support and fasten to tape rolls of different sizes, and an operating section of a tape roll held on the second holding portion is extended through the opening of the first holding portion to reach the tape dispenser.

The first holding portion further comprises at least one fastening protrusion to assist supporting and fastening to an inner wall of the tape roll.

The second holding portion comprises at least two fastening protrusions located on two corresponding ends of arbitrary orthogonal diagonals, respectively, to assist supporting and fastening to an inner wall of the tape roll.

A distance from a center of the shaft to the opening of the first holding portion is smaller or larger than a distance from a center of the second holding portion to the opening of the first holding portion.

In summary, the effects and features of the present invention are to let the first holding portion and the second holding portion of the tape spindle hold tape rolls of different sizes by allowing the tape spindle to accommodate the purpose of the user to hold tape rolls on the first holding portion and the second holding portion of the tape spindle according to their sizes, and to let the shaft of the tape spindle not move with the rotation of the tape roll by the eccentric design of the second holding portion of the tape spindle; moreover, the first holding portion that is originally distanced from the tape roll no longer moves toward the tape roll due to inertia and is prevented from contacting with the tape roll. As a result, the smoothness of pulling the tape roll is enhanced, and the convenience of the usage of the tape dispenser is also consequently improved, so as to achieve the expected effects and purposes of the invention.

The structures, operation features, and anticipated effects of the eccentric tape spindle of the present invention shall be described in detail in the subsequent embodiments and the details are not repeated here.

DETAILED DESCRIPTION OF THE INVENTION

The structures, features, and effects of the invention shall be fully described by the subsequent embodiments with references made to the accompanying drawings; it should be noted that same labels in the subsequent embodiments and drawings represent identical or similar elements, devices, components, structures, or apparatuses.

Figure 1:
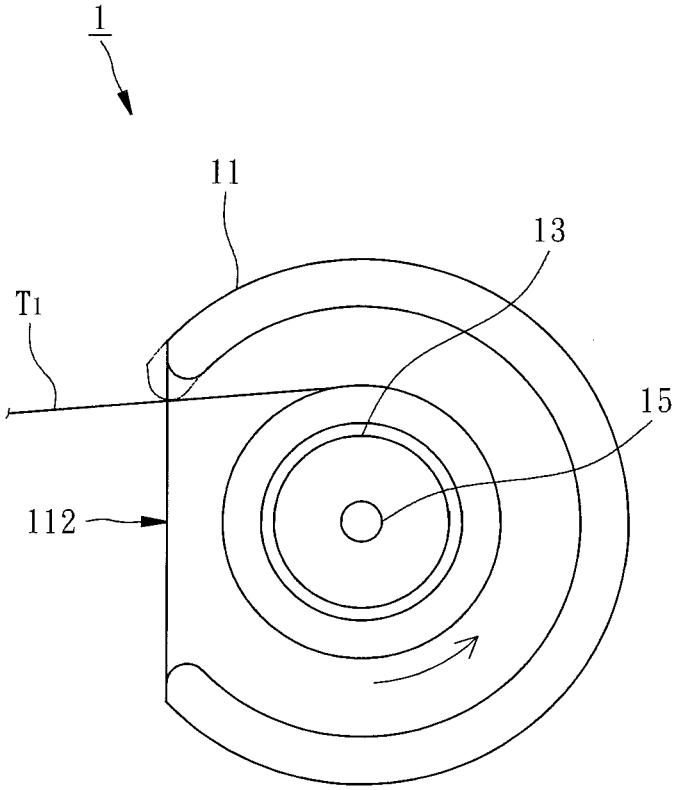
FIG. 1 PRIOR ART
FIG. 1 is a schematic of an application scheme of a conventional structure.
Figure 2:
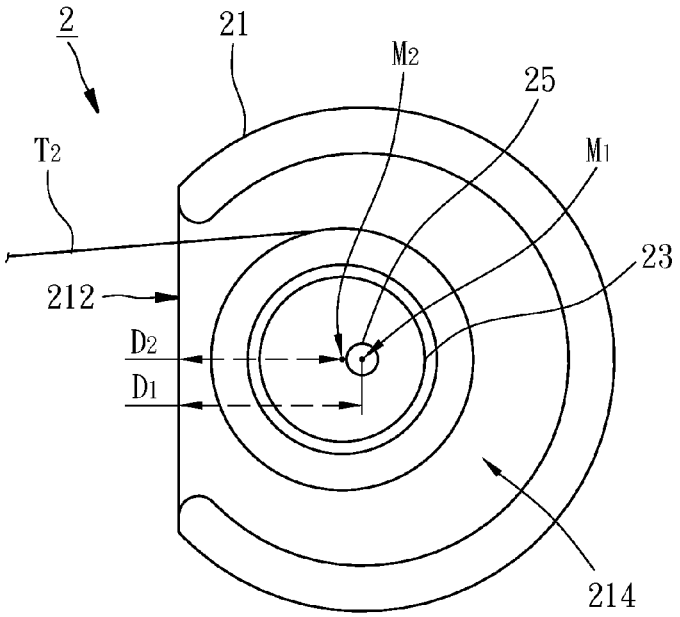
FIG. 2 is a schematic of a first application scheme of a first preferred embodiment of the present invention.
Figure 3:
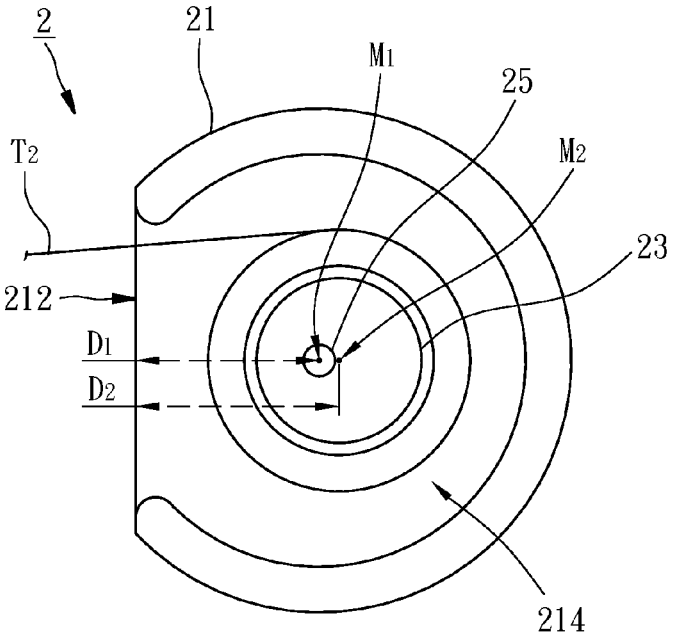
FIG. 3 is a schematic of a second application scheme of the first preferred embodiment of the present invention.

FIG. 2 and FIG. 3 show a tape spindle 2 suitable for holding tape rolls of different sizes of a first preferred embodiment of the present invention, where the tape spindle 2 comprises: a first holding portion 21, a second holding portion 23, and a shaft 25 for pivotally configuring on a tape dispenser 20, wherein the first holding portion 21 comprises an opening 212 and a container 214 that is configured on a side of the first holding portion 21 and is open, and the container 214 is connected with the opening 212, wherein the shaft 25 coaxially penetrates the first holding portion 21 and the second holding portion 23 configured in the container 214, and the shaft 25 eccentrically penetrates the second holding portion 23, and wherein a presumed distance D1 from a presumed center M1 of the shaft 25 to the opening 212 of the first holding portion 21 is smaller or larger than a presumed distance D2 from a presumed center M2 of the second holding portion 23 to the opening 212 of the first holding portion 21.

The above is the structural features of the first preferred embodiment of the present invention, and the structural features, anticipated effects, and purposes of a second preferred embodiment of the present invention shall be described in below.

FIG. 4 to FIG. 8 show a tape spindle 3 suitable for holding tape rolls of different sizes of a second preferred embodiment of the present invention, which is mainly the same as the previous embodiment while the differences are: the first holding portion 21 comprises at least one fastening protrusion 216 to assist supporting and fastening to an inner wall of a tape roll $T_2$; the second holding portion 23 is constructed by a column with at least two orthogonal diagonals, and the second holding portion 23 comprises at least two fastening protrusions 236 located on two corresponding ends of arbitrary orthogonal diagonals, respectively, to assist supporting and fastening to an inner wall of the tape roll to achieve point-contact fastening effects.

In the second preferred embodiment of the present invention, the first holding portion 21 is configured with four fastening protrusions 216 adjacent to a periphery of the first holding portion 21, while the second holding portion 23 is configured with four fastening protrusions 236 located on the ends of two orthogonal diagonals of the second holding portion 23, respectively, and the second holding portion 23 has a kite configuration.

Figure 4:
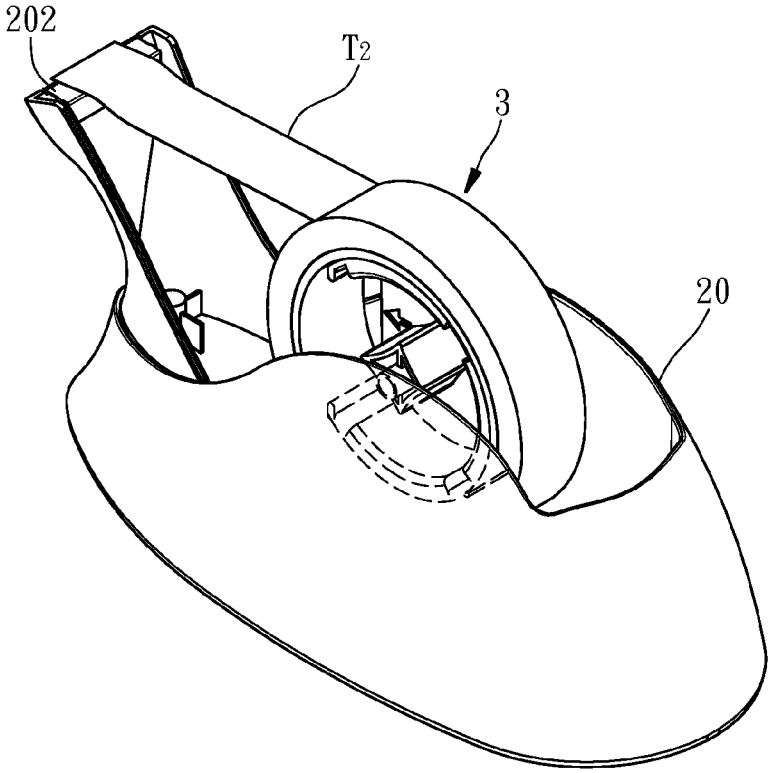
FIG. 4 is a schematic of a first application scheme of a second preferred embodiment of the present invention.
Figure 5:
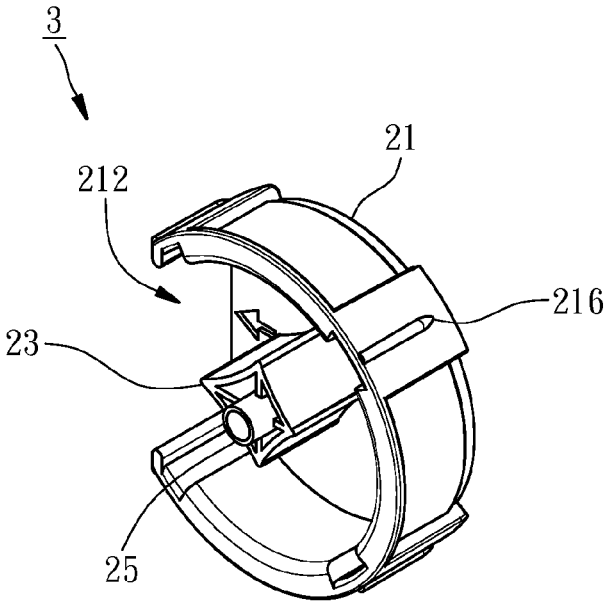
FIG. 5 is a schematic of a structure of the second preferred embodiment of the present invention from a first view angle.
Figure 6:
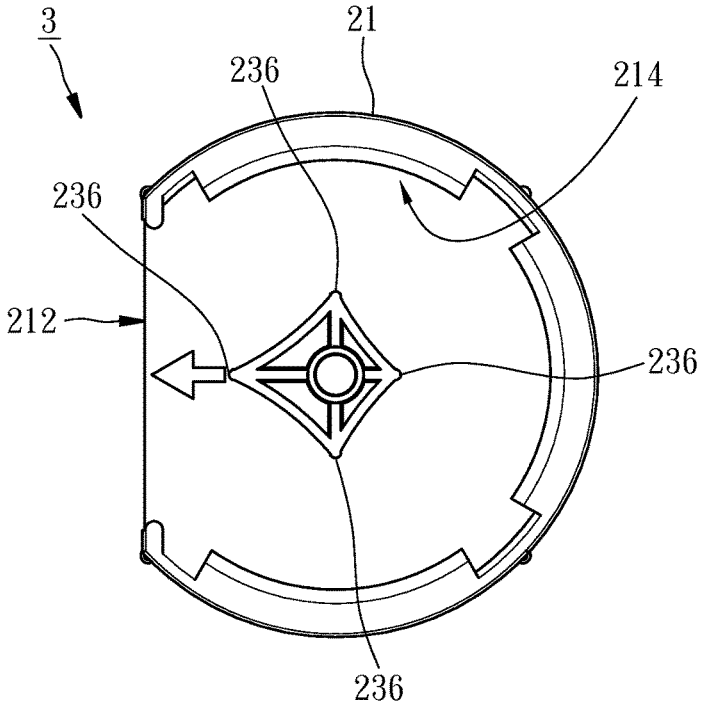
FIG. 6 is a schematic of a structure of the second preferred embodiment of the present invention from a second view angle.
Figure 7:
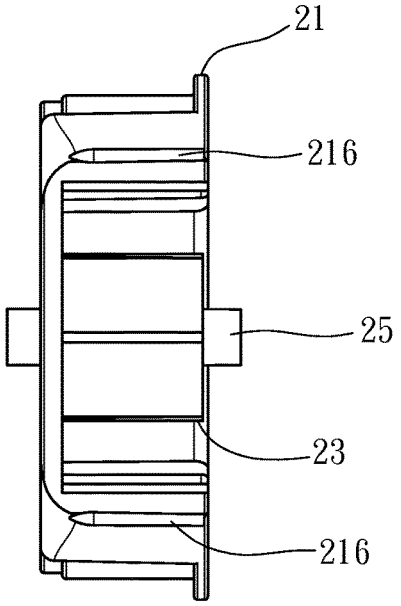
FIG. 7 is a schematic of a structure of the second preferred embodiment of the present invention from a third view angle.
Figure 8:
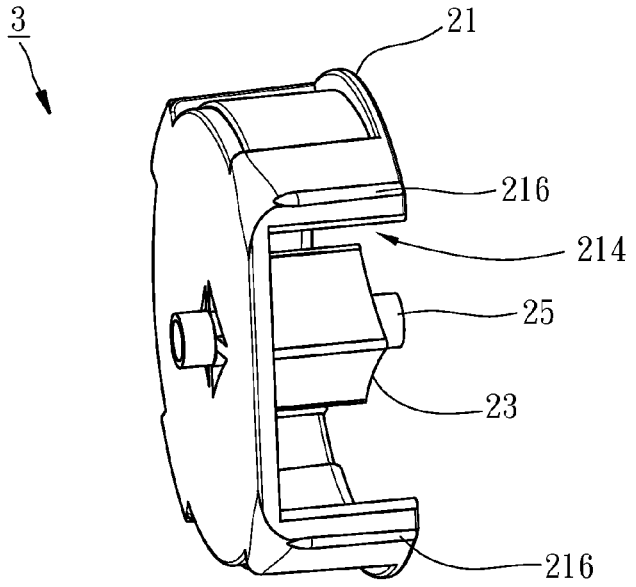
FIG. 8 is a schematic of a structure of the second preferred embodiment of the present invention from a fourth view angle.

FIG. 4 shows a first application scheme of the tape spindle 3 of the second preferred embodiment of the present invention pivotally configured on the tape dispenser 20, where the structural features and effects are: the tape roll $T_2$ of a first size is held on the first holding portion 21 so that the four fastening protrusions 216 of the first holding portion 21 assist supporting and fastening to the inner wall of the tape roll $T_2$, and the shaft 25 of the tape spindle 3 is pivotally configured on the tape dispenser 20 so that an operating section of the tape roll $T_2$ may be extended to reach a cutter 202 of the tape dispenser 20 along with the rotation of the shaft 25 of the tape spindle 3. As a result, the anticipated effects and purposes of the first application scheme of the tape spindle 3 of the second preferred embodiment of the present invention are achieved.

Figure 9:
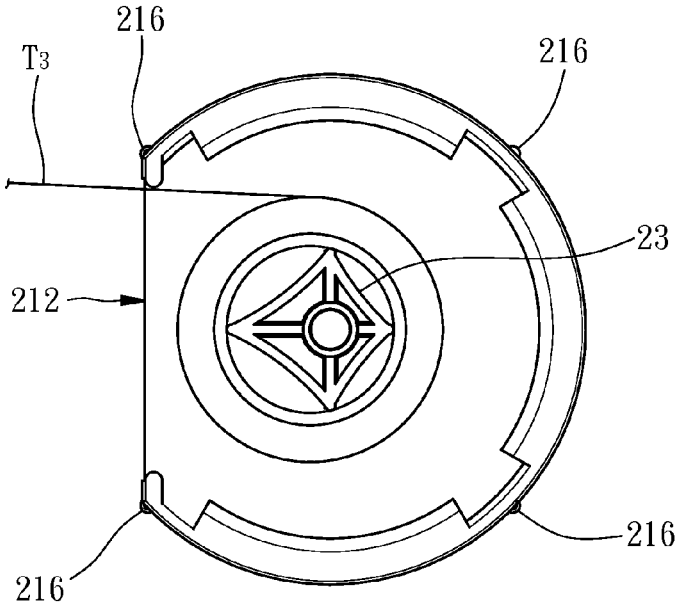
FIG. 9 is a schematic of a second application scheme of the second preferred embodiment of the present invention from a first view angle.
Figure 10:
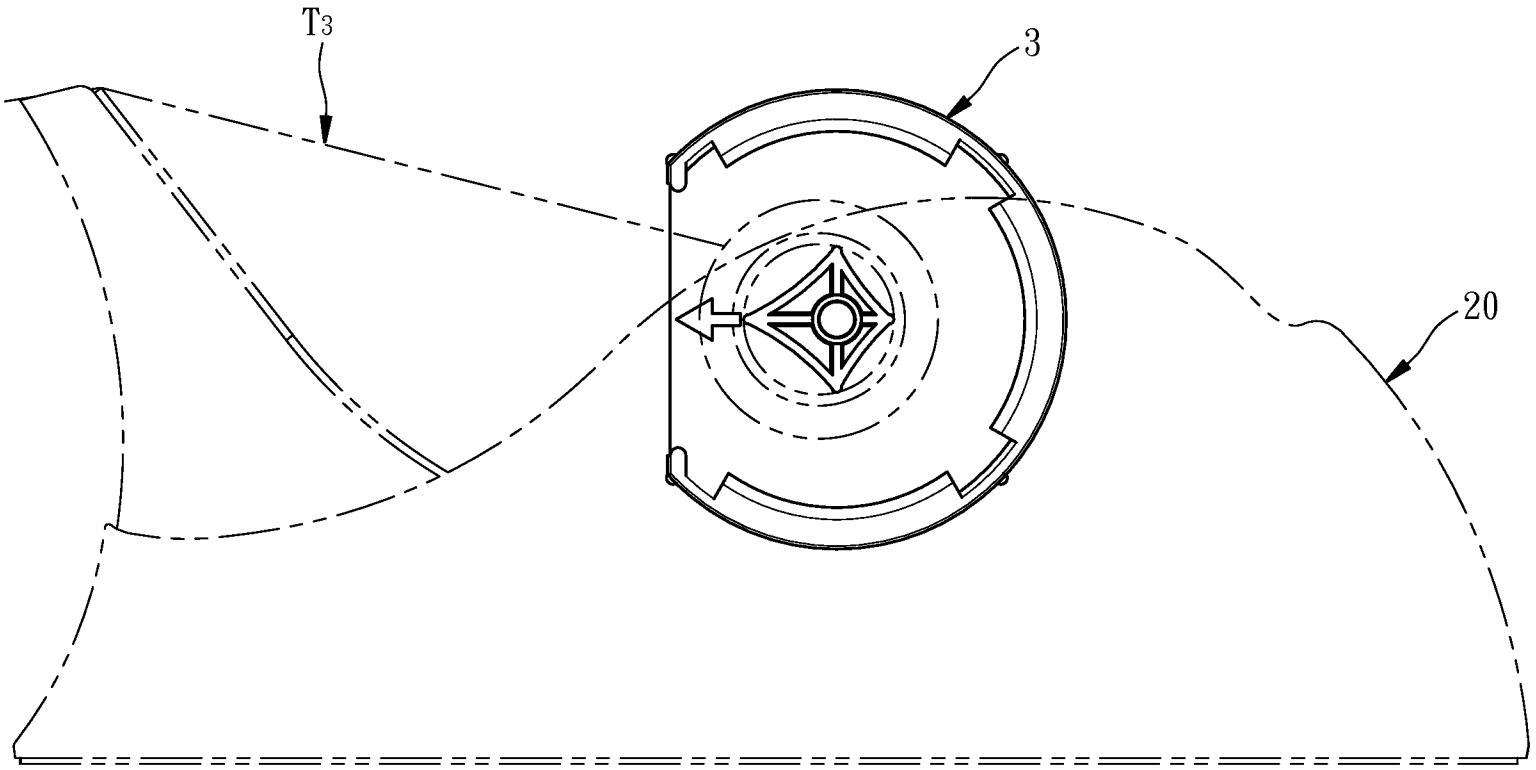
FIG. 10 is a schematic of a second application scheme of the second preferred embodiment of the present invention from a second view angle.

FIG. 9 and FIG. 10 show a second application scheme of the tape spindle 3 of the second preferred embodiment of the present invention pivotally configured on the tape dispenser 20, where the structural features and effects are: a tape roll $T_3$ of a size different from the first size is held on the second holding portion 23 so that the four fastening protrusions 236 of the second holding portion 23 assist supporting and fastening to the inner wall of the tape roll $T_3$ and achieve point-contact fastening with the inner wall of the tape roll $T_3$, respectively, so that when the tape roll $T_3$ is extended, the friction force between the inner wall of the tape roll $T_3$ and the four fastening protrusions 236 is increased, and the shaft 25 of the tape spindle 3 does not to move with the rotation of the tape roll $T_3$ after the tape roll $T_3$ overcomes the friction force from the four fastening protrusions 236; therefore, an operating section of the tape roll $T_3$ may be extended through the opening 212 of the first holding portion 21 to reach the cutter 202 of the tape dispenser 20. As a result, the anticipated effects and purposes of the second application scheme of the tape spindle 3 of the second preferred embodiment of the present invention are achieved.

In summary, by the tape spindles 2 and 3 of the above embodiments, the tape dispenser 20 may be used and operated to change among the first and second application scheme to accommodate the purpose of the user, so as to not only let the first holding portion 21 and the second holding portion 23 of the tape spindles 2 and 3 hold tape rolls $T_2$ and $T_3$ of different sizes, but also let the shaft 25 of the tape spindles 2 and 3 not move with the rotation of the tape rolls $T_2$ and $T_3$ by the eccentric design of the second holding portion 23 of the tape spindles 2 and 3; moreover, the first holding portion 21 that is originally distanced from the tape rolls $T_2$ and $T_3$ no longer moves toward the tape rolls $T_2$ and $T_3$ due to inertia and is prevented from contacting with the tape rolls $T_2$ and $T_3$. As a result, the smoothness of pulling the tape rolls $T_2$ and $T_3$ is enhanced, and the convenience of the usage of the tape dispenser 20 is also consequently improved, so as to achieve the expected effects and purposes of the invention.

The above is the structural features, anticipated effects, and purposes of the first and second preferred embodiments of the present invention, and the structural features, anticipated effects, and purposes of a third preferred embodiment of the present invention shall be described in below.

Figure 11:
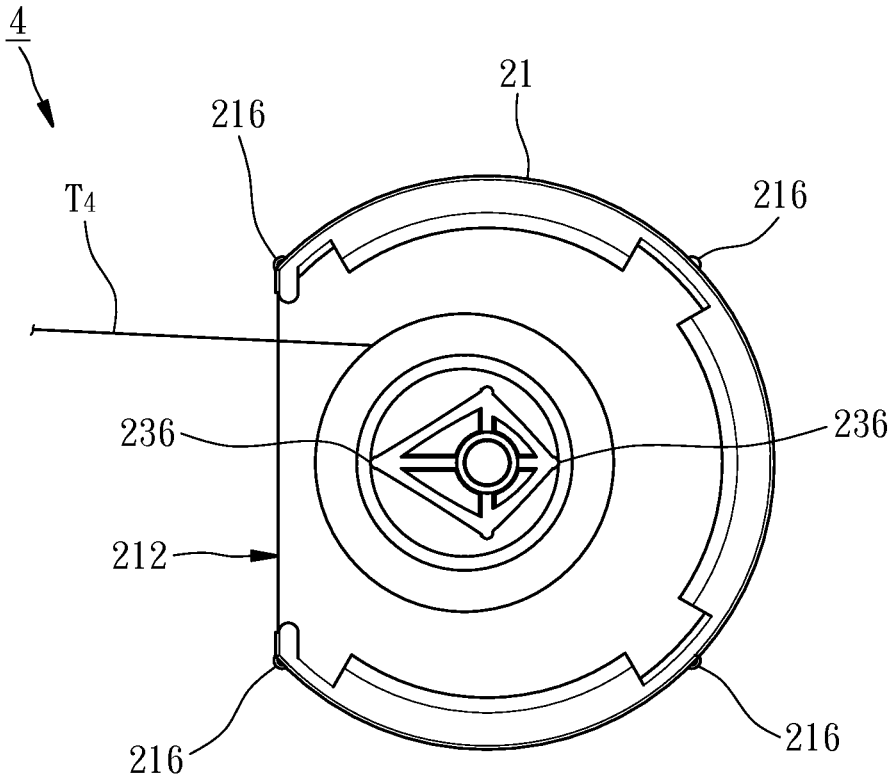
FIG. 11 is a schematic of an application scheme of a third preferred embodiment of the present invention.

FIG. 11 shows a tape spindle 4 suitable for holding tape rolls of different sizes of a third preferred embodiment of the present invention, which is mainly the same as the previous embodiment while the differences are: at least two fastening protrusions 236 of the second holding portion 23 assist supporting and fastening to an inner wall of a tape roll $T_4$ and achieve at least two point-contact fastening with the inner wall of the tape roll $T_4$, respectively, so that when the tape roll $T_4$ is extended, the friction force between the inner wall of the tape roll $T_4$ and the two fastening protrusions 236 is similarly increased, and the shaft 25 of the tape spindle 4 does not to move with the rotation of the tape roll $T_4$ after the tape roll $T_4$ overcomes the friction force from the two fastening protrusions 236; therefore, an operating section of the tape roll $T_4$ may be extended through the opening 212 of the first holding portion 21 to reach the cutter 202 of the tape dispenser 20. As a result, the anticipated effects and purposes of the tape spindle 4 of the third preferred embodiment of the present invention are achieved.

Finally, it should be mentioned that those skilled in the art may understand that the detailed description and embodiments of the invention are only illustrative of the structures and anticipated effects of the present invention and are not restrictive of the scope of the appended claims of the present invention; substitutions or modifications by other equivalent elements, devices, components, structures, or apparatuses must be deemed falling within the scope of the appended claims.

What is claimed is:

1. A tape spindle, comprising:

a first holding portion;

a second holding portion; and a shaft, for pivotally configuring on a tape dispenser, wherein the first holding portion comprises an opening and a container that is configured on a side of the first holding portion and is open, and the container is connected with the opening, wherein the shaft coaxially penetrates the first holding portion and the second holding portion configured in the container, and the shaft eccentrically penetrates the second holding portion, and wherein the first holding portion is adapted for supporting thereon a first tape roll and the second holding portion is adapted for supporting thereon a second tape roll in a way that an operating section of the second tape roll is extended through the opening of the first holding portion;

wherein the second holding portion comprises one first fastening protrusion and three second fastening protrusions, which are adapted for being abutted against an inner wall of the second tape roll and located at four vertices of an imaginary kite;

wherein the one first fastening protrusion and the three second fastening protrusions are arranged surrounding around the shaft in a way that the shaft is located at an intersection between a first imaginary line, which passes through the one first fastening protrusion and one of the three second fastening protrusions, and a second imaginary line, which passes through the other two of the three second fastening protrusions;

wherein a distance from a center of the shaft to the first fastening protrusion is greater than a distance from the center of the shaft to any of the three second fastening protrusions and the first fastening protrusion is closer to the opening of the first holding portion than any of the three second fastening protrusions.

2. The tape spindle as claimed in claim 1, wherein the first holding portion further comprises at least one fastening protrusion adapted for being abutted against an inner wall of the first tape roll.

* * * * *